US012729418B2

(12) United States Patent
Lee et al.

(10) Patent No.: US 12,729,418 B2
(45) Date of Patent: Sep. 8, 2026

(54) NON-ORIENTED ELECTRICAL STEEL SHEET AND METHOD FOR MANUFACTURING SAME

(71) Applicant: POSCO Co., Ltd, Pohang-si (KR)

(72) Inventors: Hunju Lee, Pohang-si (KR); Su-Yong Shin, Pohang-si (KR); Yunsu Kim, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 402 days.

(21) Appl. No.: 18/287,975

(22) PCT Filed: Dec. 19, 2022

(86) PCT No.: PCT/KR2022/020753
§ 371 (c)(1),
(2) Date: Oct. 23, 2023

(87) PCT Pub. No.: WO2023/121191
PCT Pub. Date: Jun. 29, 2023

(65) Prior Publication Data

US 2024/0200175 A1 Jun. 20, 2024

(30) Foreign Application Priority Data

Dec. 21, 2021 (KR) ..... 10-2021-0183665

(51) Int. Cl.

| | |
|---|---|
| ***C22C 38/02*** | (2006.01) |
| ***C21D 6/00*** | (2006.01) |
| ***C21D 8/1216*** | (2026.01) |
| ***C21D 8/1244*** | (2026.01) |
| ***C21D 9/46*** | (2006.01) |
| ***C22C 38/00*** | (2006.01) |
| ***C22C 38/04*** | (2006.01) |
| ***C22C 38/06*** | (2006.01) |
| ***C22C 38/18*** | (2006.01) |
| ***C22C 38/60*** | (2006.01) |

(52) U.S. Cl.
CPC ..... *C22C 38/02* (2013.01); *C21D 6/008* (2013.01); *C21D 8/1222* (2013.01); *C21D 8/1233* (2013.01); *C21D 8/1261* (2013.01); *C21D 8/1272* (2013.01); *C21D 9/46* (2013.01); *C22C 38/002* (2013.01); *C22C 38/004* (2013.01); *C22C 38/04* (2013.01); *C22C 38/06* (2013.01); *C22C 38/18* (2013.01); *C22C 38/60* (2013.01)

(58) Field of Classification Search
CPC ..... C22C 38/02; C22C 38/002; C22C 38/004; C22C 38/04; C22C 38/06; C22C 38/18; C22C 38/60; C22C 38/001; C22C 38/008; C22C 38/12; C22C 38/14; C22C 38/22; C22C 38/24; C22C 38/26; C22C 38/34; C22C 38/00; C22C 38/28; C22C 38/32; C22C 38/38; C21D 6/008; C21D 8/1222; C21D 8/1233; C21D 8/1261; C21D 8/1272; C21D 9/46; C21D 6/005; C21D 8/12; H01F 1/147
See application file for complete search history.

(56) References Cited

U.S. PATENT DOCUMENTS

| | | | | |
|---|---|---|---|---|
| 11,124,854 | B2 | 9/2021 | Fujimura et al. | |
| 2015/0000793 | A1* | 1/2015 | Park | C22C 38/004 148/307 |
| 2020/0332387 | A1 | 10/2020 | Kim et al. | |
| 2023/0416883 | A1 | 12/2023 | Chu et al. | |

FOREIGN PATENT DOCUMENTS

| | | | |
|---|---|---|---|
| CN | 103290190 | A | 9/2013 |
| CN | 109943766 | A | 6/2019 |
| CN | 111556904 | A | 8/2020 |
| CN | 112430778 | A | 3/2021 |
| EP | 3399061 | A1 | 11/2018 |
| JP | H08-295936 | A | 11/1996 |
| JP | 2001-247943 | A | 9/2001 |
| JP | 2005-120403 | A | 5/2005 |
| JP | 2005-256019 | A | 9/2005 |
| JP | 2019-167606 | A | 10/2019 |
| JP | 2021-031714 | A | 3/2021 |
| JP | 2021-036075 | A | 3/2021 |
| JP | 2001-172753 | A | 6/2021 |
| KR | 10-1203791 | B1 | 11/2012 |
| KR | 10-2015-0126334 | A | 11/2015 |

(Continued)

OTHER PUBLICATIONS

Extended European Search Report dated Mar. 24, 2025 issued in corresponding European Patent Application No. 22911824.5.

(Continued)

*Primary Examiner* — Adil A. Siddiqui

(74) *Attorney, Agent, or Firm* — Morgan Lewis & Bockius LLP

(57) ABSTRACT

A non-oriented electrical steel sheet includes by wt %, Si: 3.0 to 4.0%, Al: 0.1 to 1.5%, Mn: 0.1 to 0.5%, Cr: 2 to 20% of Mn content, a sum of Sn and Sb: 0.006 to 0.1%, C: 0.0010 to 0.0050%, and 0.0003 to 0.0050% of at least one of N, S, Ti, Nb, and V, and balance being Fe and unavoidable impurities, in which an area fraction of a grain having a grain diameter which is 10% or less of a thickness of the steel sheet is 0.5% or more, a number fraction of the grain is 20% or more, and an average grain diameter from a central layer to a surface layer in a thickness direction of the steel sheet satisfies a relationship of D(surface)/D(center)≥0.6.

4 Claims, No Drawings

(56) References Cited

FOREIGN PATENT DOCUMENTS

| | | | |
|---|---|---|---|
| KR | 10-2016-0078182 | A | 7/2016 |
| KR | 10-1842417 | B1 | 3/2018 |
| KR | 10-2019-0104580 | A | 9/2019 |
| KR | 10-2020-0035765 | A | 4/2020 |
| KR | 10-2020-0065140 | A | 6/2020 |
| KR | 10-2020-065141 | A | 6/2020 |
| KR | 10-2021-0078978 | A | 6/2021 |
| KR | 10-2021-0080658 | A | 7/2021 |
| KR | 10-2021-0080726 | A | 7/2021 |
| WO | 2009/128428 | A1 | 10/2009 |
| WO | 2017/115657 | A1 | 7/2017 |

OTHER PUBLICATIONS

International Search Report dated Mar. 24, 2023 issued in International Patent Application No. PCT/KR2022/020753 (with English translation).

Office Action and Search Report dated Aug. 7, 2025 issued in the corresponding Chinese Patent Application No. 202280036106.X. (Note: KR 10-2021-0078978 A, and KR 10-2021-0080658 A already submitted).

Chinese Notice of Allowance dated Jan. 6, 2026 issued in Chinese Patent Application No. 202280036106.X.

Office Action dated Jan. 7, 2025, issued in corresponding Japanese Patent Application No. 2023-570069.

Office Action dated Apr. 29, 2026 issued in the corresponding Indian Patent Application No. 202337072832 with the English translation.

* cited by examiner

NON-ORIENTED ELECTRICAL STEEL SHEET AND METHOD FOR MANUFACTURING SAME

CROSS-REFERENCE OF RELATED APPLICATIONS

This application is the U.S. National Phase under 35 U.S.C. § 371 of International Patent Application No. PCT/KR2022/020753, filed on Dec. 19, 2022, which in turn claims the benefit of Korean Application No. 10-2021-0183665, filed on Dec. 21, 2021, the disclosures of which applications are incorporated by reference herein.

TECHNICAL FIELD

An embodiment of the present invention relates to a non-oriented electrical steel sheet and a method for manufacturing the same. More particularly, an embodiment of the present invention relates to a non-oriented electrical steel sheet having improved strength and magnetism by precisely controlling a manufacturing process for uniformly forming fine grains simultaneously with controlling components that enhance strength, and a method for manufacturing the same.

BACKGROUND ART

A non-oriented electrical steel sheet is mainly used in a motor that converts electrical energy into mechanical energy. In order to exhibit high efficiency during the energy conversion, magnetic properties of the non-oriented electrical steel sheet should be excellent.

Countries around the world are reorganizing their industry structure into an eco-friendly, low-carbon centered industry to prepare for the carbon-neutral era. In accordance with this trend, in case of automobiles, internal combustion engines are rapidly being replaced by electric vehicles. Drive motors used in the electric vehicles account for the majority of electrical energy consumption, and thus, interest and demand for a non-oriented electrical steel sheet, which is used as a core material for the drive motor, are increasing. Under the background, as a method for increasing efficiency of drive motor, interest in a method for simultaneously increasing magnetic properties and strength of a non-oriented electrical steel sheet is increasing.

The magnetic properties of the non-oriented electrical steel sheet are mainly evaluated by core loss and magnetic flux density. The core loss means an energy loss that occurs at specific magnetic flux density and frequency, and the magnetic flux density means a degree of magnetization obtained under a specific magnetic field. The lower the core loss, the higher the energy efficiency of the motor may be manufactured under the same conditions, and the higher the magnetic flux density, the smaller the motor or the lower the copper loss. Therefore, it is important to make a non-oriented electrical steel sheet with low core loss and high magnetic flux density. Using the non-oriented electrical steel sheet with these characteristics, the drive motor with excellent efficiency and torque may be made, and as a result, it is possible to improve a mileage and output of an eco-friendly vehicle.

Meanwhile, the characteristics of the non-oriented electrical steel sheet should also consider the operating conditions of the motor. As general criteria for evaluating the characteristics of the non-oriented electrical steel sheet used in the motor, when a 1.5 T magnetic field is applied at a commercial frequency of 50 Hz, W15/50 core loss is widely used. However, in the non-oriented electrical steel sheet having a thickness of 0.35 mm or less used in the drive motor of the eco-friendly vehicle, magnetic properties are often important in a low magnetic field of 1.0 T or less and a high frequency of 400 Hz or more, and therefore, the characteristics of non-direction electrical steel sheet is often evaluated with W10/400 core loss.

In addition, the non-oriented electrical steel sheet for a drive motor for a high-efficiency, eco-friendly vehicle also requires excellent strength as well as magnetic properties. The drive motor for the eco-friendly vehicle is mainly designed in the form in which a permanent magnet is inserted into a rotor. In order for the permanent magnet insertion type motor to exhibit excellent performance, the permanent magnet should be positioned outside the rotor so as to be as close to a stator as possible.

However, when the strength of the electrical steel sheet is low when the motor rotates at high speed, the permanent magnet inserted into the rotor may be separated by centrifugal force. Therefore, to secure the performance and durability of the motor, the electrical steel sheet with high strength is required. In particular, when considering the temperature rise due to the operation of the motor, the electrical steel sheet needs to have excellent strength at 120 to 200° C.

A commonly used method to simultaneously increase the magnetic properties and strength of the non-oriented electrical steel sheet is to add alloy elements such as Si, Al, and Mn. When the specific resistance of the steel increases through the addition of the alloying elements, an eddy current loss may decrease, thereby lowering the total core loss.

In addition, an alloying element may be dissolved as a substitutional element in iron to cause a strengthening effect, thereby increasing strength. On the other hand, as the addition amount of alloy elements such as Si, Al, and Mn increases, there is a problem in that the magnetic flux density deteriorates and embrittlement increases. When more than a certain amount of alloying elements are added, cold rolling becomes impossible, making commercial production impossible. In particular, the thinner the thickness of the electrical steel sheet, the better the high-frequency core loss, but the decrease in rollability due to the embrittlement is a fatal problem. The maximum value of the total content of Si, Al, and Mn that can be commercially produced is known to be approximately 4.5%. In addition, by optimizing the content of trace elements, it is possible to produce the high-end non-direction electrical steel sheet with excellent magnetism and strength.

Depending on the design intention of the motor, the electrical steel sheet with improved strength may be used even though the magnetic properties are somewhat deteriorated. As a method for manufacturing an electrical steel sheet for this purpose, there are a method using precipitation of interstitial elements and a method of reducing a grain diameter. In order to increase the rotation speed by miniaturizing the motor or to increase the effect of the permanent magnet inserted into the rotor, even if the magnetic properties of the electrical steel sheet are slightly deteriorated, the rotor made of the electrical steel sheet having significantly improved strength is mainly used.

In this case, when fine precipitates containing interstitial solid-solution elements such as C, N, and S are formed, the effect of increasing the strength is good, but the core loss rapidly deteriorates, which may rather reduce the efficiency of the motor. In addition, the method of reducing a grain diameter has the disadvantage of increasing a deviation in quality of mass-produced products due to the increase in the non-uniformity of the steel sheet material due to the mixing of the non-recrystallized part.

In order to solve the above problems, there is a method of making a non-oriented electrical steel sheet that simultaneously increases magnetism and strength by controlling a cooling rate of a final annealing process. However, there is a problem in that it is difficult to apply the steel sheet manufactured by the method to the mass production process since the non-recrystallized part is mixed and the material is non-uniform.

In addition, most of the previously proposed technologies for simultaneously improving magnetism and strength are ignored due to increased manufacturing costs, decreased productivity and real yield, or poor improvement effects.

DISCLOSURE

Technical Problem

The present disclosure attempts to provide a non-oriented electrical steel sheet and a method for manufacturing the same. Specifically, an embodiment of the present invention provides a non-oriented electrical steel sheet excellent in strength and core loss at the same time by carefully controlling pre-annealing and final annealing processes so that since a sufficient large number of fine grains are present in the steel sheet to have excellent yield strength, and at the same time, fine grains are uniformly distributed to the center layer without being concentrated on the surface layer, and a method for manufacturing the same.

Technical Solution

According to an embodiment of the present invention, a non-oriented electrical steel sheet may include, by wt %, Si: 3.0 to 4.0%, Al: 0.1 to 1.5%, Mn: 0.1 to 0.5%, Cr: 2 to 20% of Mn content, a sum of Sn and Sb: 0.006 to 0.1%, C: 0.0010 to 0.0050%, and 0.0003 to 0.0050% of at least one of N, S, Ti, Nb, and V, and balance being Fe and unavoidable impurities, in which an area fraction of a grain having a grain diameter which is 10% or less of a thickness of the steel sheet may be 0.5% or more, a number fraction of the grain may be 20% or more, and an average grain diameter from a central layer to a surface layer in a thickness direction of the steel sheet may satisfy a relationship of Equation 1 below.

$$D(\text{surface})/D(\text{center}) \geq 0.6 \quad \text{[Equation 1]}$$

(In Equation 1, D (surface): represents average grain diameter of a region from the surface layer in the thickness direction of the steel sheet to a ¼ layer, D (center): represents an average grain diameter of a region from a central layer to the ¼ layer in the thickness direction of the steel sheet.)

The average grain diameter of the steel sheet may be 50 to 150 μm.

A yield strength YS (RT) of the steel sheet may be 400 MPa or more and a 150° ° C. yield strength YS (150° C.) may be 340 MPa or more.

A thickness of the steel sheet may be 0.1 to 0.35 mm.

A method for manufacturing non-oriented electrical steel sheet includes: a step of preparing a slab containing, by wt %, Si: 3.0 to 4.0%, Al: 0.1 to 1.5%, Mn: 0.1 to 0.5%, Cr: 2 to 20% of Mn content, a sum of Sn and Sb: 0.006 to 0.1%, C: 0.0010 to 0.0050%, and 0.0003 to 0.0050% of at least one of N, S, Ti, Nb, and V, and balance being Fe and unavoidable impurities; a step of manufacturing a hot-rolled steel sheet by heating and hot-rolling the slab; a hot-rolled steel sheet pre-annealing step including a primary pre-annealing step of heating the hot-rolled steel sheet to 950 to 1,150 □C and then maintaining the hot-rolled steel sheet for 40 seconds or more and a secondary pre-annealing step of changing the hot-rolled steel sheet to a temperature atmosphere of 850 to 950 □C within 20 seconds and maintaining the hot-rolled steel sheet for 20 seconds or more; a step of manufacturing a cold-rolled steel sheet by cold-rolling the hot-rolled steel sheet after the pre-annealing of the hot-rolled steel sheet; and a final annealing step including a first final annealing step in which the cold-rolled steel sheet is heated to 900° C. or higher in a mixed atmosphere of hydrogen H2 and nitrogen N2 and then maintained for 60 seconds or less and a secondary final annealing step in which the cold-rolled steel sheet is maintained at a temperature of 650 to 850° C. for 15 seconds or more.

The slab may be heated to 1,200° C. or lower.

In the step of manufacturing the hot-rolled steel sheet, finish hot rolling may be performed at 800° C. or higher.

In the primary pre-annealing step, the hot-rolled steel sheet may be heated at a temperature rise rate of 10° C./s or higher.

In the primary pre-annealing step, the cold-rolled steel sheet may be heated at a temperature rise rate of 25° C./s or higher.

In the final annealing step, the temperature of the cold-rolled steel sheet may rise by applying a rolling direction tension of 0.75 kgf/mm$^2$ or less.

Advantageous Effects

According to an embodiment of the present invention, it is possible to provide a non-oriented electrical steel sheet excellent in strength and core loss by carefully controlling pre-annealing and final annealing processes so that since a sufficient large number of fine grains are present in the steel sheet to have excellent yield strength, and at the same time, fine grains are uniformly distributed to the center layer without being concentrated on the surface layer.

When such non-oriented electrical steel sheet, which has excellent strength and core loss, is used for a drive motor for a high-end eco-friendly vehicle, it is possible to greatly improve performance of a drive motor.

MODE FOR INVENTION

The terms first, second, third, and the like are used to describe, but are not limited to, various parts, components, areas, layers and/or sections. These terms are used only to distinguish a part, component, region, layer, or section from other parts, components, regions, layers, or sections. Accordingly, a first part, a component, an area, a layer, or a section described below may be referred to as a second part, a component, a region, a layer, or a section without departing from the scope of the present disclosure.

Terminologies used herein are to mention only a specific exemplary embodiment, and do not to limit the present invention. Singular forms used herein include plural forms as long as phrases do not clearly indicate an opposite meaning. The meaning "including" used in the present specification concretely indicates specific properties, areas, integer numbers, steps, operations, elements, and/or components, and is not to exclude presence or addition of other specific properties, areas, integer numbers, steps, operations, elements, and/or components thereof.

When a part is referred to as being "above" or "on" other parts, it may be directly above or on other parts, or other parts may be included in between. In contrast, when a part is referred to as being "directly above" another part, no other part is involved in between.

In addition, unless otherwise specified, % means wt %, and 1 ppm is 0.0001 wt %.

In an embodiment, further including additional elements means that the balance being iron (Fe) is replaced and included as much as the additional amount of the additional elements.

All terms including technical terms and scientific terms used herein have the same meaning as the meaning generally understood by those skilled in the art to which the present invention pertains unless defined otherwise. Terms defined in commonly used dictionaries are additionally interpreted as having meanings consistent with related technical literature and currently disclosed content, and are not interpreted in ideal or very formal meanings unless defined.

Hereinafter, an embodiment will be described in detail so that a person of ordinary skill in the art to which the present invention pertains can easily implement the present invention. As those skilled in the art would realize, the described embodiments may be modified in various different ways, all without departing from the spirit or scope of the present invention.

A non-oriented electrical steel sheet according to an embodiment of the present invention contains, by wt %, Si: 3.0 to 4.0%, Al: 0.1 to 1.5%, Mn: 0.1 to 0.5%, Cr: 2 to 20% of Mn content, a sum of Sn and Sb: 0.006 to 0.1%, C: 0.0010 to 0.0050%, and 0.0003 to 0.0050% of at least one of N, S, Ti, Nb, and V, and balance being Fe and unavoidable impurities.

Hereinafter, the reason for limiting components of the non-direction electrical steel sheet will be described.

[Si: 3.0 to 4.0 wt %]

Silicon (Si) serves to lower core loss by increasing a specific resistance of a material and to increase strength of a steel sheet by solid solution strengthening. When too little Si is added, the effect of improving core loss and strength may be insufficient. When too much Si is added, embrittlement of the material increases, and rolling productivity is drastically lowered, and an oxide layer and an oxide in a surface layer portion that are harmful to magnetism may be formed. Accordingly, Si may be contained in an amount of 3.0 to 4.0 wt %. More specifically, Si may be contained in an amount of 3.1 to 3.8 wt %.

[Al: 0.3 to 1.5 wt %]

Aluminum (Al) serves to lower core loss by increasing a specific resistance of a material and to increase strength of a steel sheet by solid solution strengthening. When too little Al is added, it may be difficult to obtain the effect of magnetic improvement due to the formation of fine nitrides. When too much Al is added, nitrides are excessively formed, resulting in a deterioration in magnetism and problems in all processes such as steelmaking and continuous casting, thereby greatly reducing productivity. Accordingly, Al may be contained in an amount of 0.30 to 1.50 wt %.

[Mn: 0.1 to 0.5 wt %]

Manganese (Mn) serves to increase a specific resistance of a material to improve core loss, and form sulfides. When too little Mn is added, fine sulfides are formed, resulting in a deterioration in magnetism, and when too much Mn is added, an oxidation behavior of a surface of a steel sheet is adversely affected, fine MnS is excessively precipitated, and the formation of {111} texture, which is unfavorable to magnetism, is promoted, resulting in rapidly reducing magnetic flux density. Accordingly, Mn may be contained in an amount of 0.1 to 0.5 wt %.

[Cr: 2 to 20% of Mn Content]

Chromium (Cr) serves to inhibit the formation of fine precipitates in a surface layer by forming a thin and dense oxide layer on a surface of a steel sheet. When too little Cr is added, it is difficult to obtain the effect of forming a dense oxide layer, and when too much Cr is added, carbides are excessively generated inside the steel sheet, resulting in a deterioration in core loss. Reviewing in more detail, when Cr is less than 2% of Mn, a rough oxide layer is formed on the surface of the steel sheet, resulting in a deterioration in magnetism, and when Cr exceeds 20% of Mn, carbonitrides are formed to increase a fraction of fine grains, resulting in a deterioration in magnetism. Accordingly, Cr may contain 2 to 20% of Mn.

[Sum of Sn and Sb: 0.006 to 0.100 wt %]

Tin (Sn) and antimony (Sb) segregate on a surface of a steel sheet and a grain boundary to serve to inhibit surface oxidation during annealing, hinder the diffusion of elements through the grain boundary, and delay the development of {111} texture. When too little Sn and Sb are added, the above effect may not be sufficient. When too much Sn and Sb are added, productivity may decrease compared to magnetism improvement due to a deterioration in toughness caused by an increase in a segregation amount at the grain boundary. Therefore, Sn and Sb may be contained in a total amount of 0.006 to 0.100 wt %. The sum of Sn and Sb means the content of Sn or Sb alone when the Sn or Sb is contained alone, and means the total amount of Sn and Sb when the Sn and Sb are contained at the same time.

[C: 0.0010 to 0.0050 wt %]

Carbon (C) causes magnetic aging and combines with other impurity elements to form carbides, resulting in a deterioration in magnetic properties, but hinders the movement of dislocations to serve to improve strength. When C is controlled to be contained too much, a fraction of fine carbides increases, resulting in a deterioration in magnetism, and when C is controlled to be contained too little, there is a problem in that productivity is excessively low. Accordingly, C may be contained in an amount of 0.0010 to 0.0050 wt %.

The non-oriented electrical steel sheet according to an embodiment of the present invention may further contain 0.0003 to 0.0050 wt % of one or more of N, S, Ti, Nb and V, respectively.

[N: 0.0003 to 0.0050 wt %]

Nitrogen (N) not only forms fine AlN precipitates inside a steel sheet, but also inhibits grain growth by combining with other impurities to form fine precipitates, thereby deteriorating core loss, but also improving strength. When N is controlled too high, a fraction of nitrides increases, resulting in a rapid deterioration in core loss, but when N is controlled too low, magnetic flux density decreases. Accordingly, N may be contained in an amount of 0.0003 to 0.0050 wt %. More preferably, N may be managed at 0.0025 wt % or less.

[S: 0.0003 to 0.0050 wt %]

Sulfur (S) forms fine precipitates, MnS, resulting in a deterioration in magnetic properties and deterioration in hot workability, so it is preferable to keep the content of sulfur low. Accordingly, S may be contained in an amount of 0.0003 to 0.0050 wt %. More specifically, S may be managed to 0.0025 wt % or less.

[Ti: 0.0003 to 0.0050 wt %]

Titanium (Ti) has a very strong tendency to form precipitates inside a steel sheet, and forms fine carbides, nitrides, or sulfides inside the steel sheet to hinder grain growth, resulting in a deterioration in core loss. Accordingly, the Ti content should be controlled to 0.005% or less, and more preferably 0.002% or less.

[Nb: 0.0003 to 0.0050 wt %]

Niobium (Nb) forms fine carbides or nitrides inside a steel sheet to inhibit grain growth and domain wall movement, resulting in a deterioration in core loss. Accordingly, the Nb content should be controlled to 0.005% or less, and more preferably 0.002% or less.

[V: 0.0003 to 0.0050 wt %]

Vanadium (V) forms fine carbides or nitrides inside a steel sheet to inhibit grain growth and domain wall movement, resulting in a deterioration in core loss. Accordingly, the V content should be controlled to 0.005% or less, and more preferably 0.002% or less.

In the non-oriented electrical steel sheet according to an embodiment of the present invention, elements such as B, Mo, Mg, and Zr may inevitably be contained during the manufacturing process. Even a trace of these components may form inclusions inside the steel sheet to deteriorate magnetic properties. Therefore, it is preferable that these components are managed to B: 0.0002 wt % or less, Mo: 0.01 wt % or less, Mg: 0.005 wt % or less, and Zr: 0.005 wt % or less.

The non-oriented electrical steel sheet according to the embodiment of the present invention contains balance being Fe and unavoidable impurities. The unavoidable impurities are impurities mixed during the steelmaking step and the process of manufacturing an oriented electrical steel sheet, and since they are well known in the relevant field, a detailed description thereof will be omitted. In an embodiment of the present invention, the addition of elements other than the above-described alloy components is not excluded, and these elements may be variously contained within a range that does not impair the technical spirit of the present invention. When additional elements are further contained, they are contained in place of Fe which is the balance.

The non-oriented electrical steel sheet according to the embodiment of the present invention having the above composition has the following physical properties.

The non-oriented electrical steel sheet according to the embodiment of the present invention has an average grain diameter of 50 to 150 μm. In addition, the grain diameter which is 10% or less of the thickness of the steel sheet is 0.5% or more in area fraction and 20% or more in number fraction of grains. In addition, an average grain diameter D (center) of an area from a central layer in a thickness direction to a ¼ layer of the steel sheet and an average grain diameter D (surface) of an area from the surface layer in a thickness direction to the ¼ layer have a relationship of [Equation 1] below.

$$D(\text{surface})/D(\text{center}) \geq 0.6 \quad \text{[Equation 1]}$$

In this way, when the steel sheet is manufactured so that the grains inside the steel sheet have a relationship between the diameter and the grain distribution in the thickness direction and [Equation 1], the yield strength and core loss of the manufactured non-oriented electrical steel sheet are simultaneously improved. This fact was confirmed by the present inventors through repeated experiments on the compositions and manufacturing process of the steel sheet.

It is considered that the reason why the yield strength and core loss were simultaneously improved by controlling the crystal structure of the steel sheet in this way is that a sufficiently large number of fine grains having a grain diameter which is 10% or less of the thickness of the steel sheet were formed by precisely controlling the Si, Al, Mn, and Cr contents that affect the oxidation behavior in the surface layer of the steel sheet, and at the same time, precisely controlling manufacturing process conditions according to an embodiment of the present invention described later, that is, pre-annealing of a hot-rolled steel sheet and final annealing conditions of a cold-rolled steel sheet in two steps. In this way, when the grains of the steel sheet are made fine and at the same time, uniformly distributed in the surface and center, it could be confirmed that the room temperature yield strength YS (RT) was also 400 MPa or more, and the 150° C. yield strength YS (150° C.) was excellent at 340 MPa, and the core loss was excellent at the same time.

A method of manufacturing a non-oriented electrical steel sheet according to an embodiment of the present invention includes a step of hot rolling a slab to manufacture a hot rolled steel sheet; a step of pre-annealing the hot-rolled steel sheet; a step of cold-rolling the hot-rolled steel sheet to manufacture a cold-rolled steel sheet; and a step of final annealing the cold-rolled steel sheet.

First, the slab is hot rolled.

Since the alloy components of the slab have been described in the alloy components of the non-oriented electrical steel sheet described above, duplicate descriptions will be omitted. Since the alloy components are not substantially changed during the manufacturing process of the non-oriented electrical steel sheet, the alloy components of the non-oriented electrical steel sheet and the slab are substantially the same.

Specifically, the slab contains, by wt %, Si: 3.0 to 4.0%, Al: 0.1 to 1.5%, Mn: 0.1 to 0.5%, Cr: 2 to 20% of Mn content, a sum of Sn and Sb: 0.006 to 0.1%, C: 0.0010 to 0.0050%, and 0.0003 to 0.0050% of at least one of N, S, Ti, Nb, and V, and the balance being Fe and unavoidable impurities, Since other additional elements have been described in the alloy components of the non-oriented electrical steel sheet, duplicated descriptions will be omitted.

The slab may be heated prior to hot rolling. The heating temperature of the slab is not limited, but the slab can be heated to 1,200° C. or lower. When the heating temperature of the slab is too high, precipitates such as AlN and MnS present in the slab are re-dissolved and then finely precipitated during the hot rolling and annealing, thereby hindering the grain growth and deteriorating the magnetism.

Next, the slab is hot-rolled to manufacture the hot-rolled steel sheet. In the step of manufacturing the hot-rolled steel sheet, the finish rolling temperature may be 800° C. or higher. Specifically, the finish rolling temperature may be 800 to 1,000° ° C. The hot-rolled steel sheet may be coiled at a temperature of 700° C. or lower.

The method may further include a step of hot-rolled sheet annealing the hot-rolled sheet after the step of manufacturing the hot-rolled sheet. In this case, the hot-rolled steel sheet annealing may be performed by being divided into two steps.

First, in the primary pre-annealing of the hot-rolled steel sheet, the hot-rolled steel sheet may be heated to 950 to 1,150° C. at a temperature rise rate of 10° C./s or higher and then maintained for 40 seconds or more. After completing the primary pre-annealing in this way, the secondary pre-annealing may be performed by changing atmosphere in a furnace to 850 to 950° C. within 20 seconds and maintaining the furnace for 20 seconds or more.

This two-step hot-rolled steel sheet pre-annealing is performed to increase the crystal orientation favorable to magnetism and to appropriately form the grain size.

The annealed hot-rolled steel sheet may be continuously pickled.

Next, the cold-rolled steel sheet is manufactured by cold-rolling the hot-rolled steel sheet. The cold rolling is finally rolled to a thickness of 0.1 mm to 0.35 mm.

Next, the cold-rolled steel sheet is subjected to the final annealing. In this case, the final annealing may also be performed by being divided into two steps.

First, the cold-rolled steel sheet is heated to 900° C. or higher at a temperature rise rate of 25° C./s or higher in a state in which a tension of 0.75 kgf/mm$^2$ or less is applied in the rolling direction of the steel sheet in a mixed atmosphere of hydrogen ($H_2$) and nitrogen ($N_2$). The cold-rolled steel sheet may be subjected to the first final annealing step by being heated in this way and maintained in the cracked state for 60 seconds or less.

Then, the second final annealing step may be performed by continuously controlling the temperature in the furnace to 650 to 850° C. and then maintaining the temperature for 15 seconds or more.

The core loss of the non-oriented electrical steel sheet is closely related to the grain size, so the final annealing step may be precisely controlled by being divided into two steps and the annealing may be performed.

In the final annealing step, a gas in which hydrogen ($H_2$) and nitrogen ($N_2$) are mixed may be used as the atmosphere in the furnace.

The average grain diameter of the steel sheet after the final annealing through the above series of processes may be 50 to 150 μm. In addition to this, the steel sheet may have an area fraction of 0.5% or more and a number fraction of 20% or more of the grain diameter which is 10% or less of the plate thickness, and the average grain diameter D (center) of the area from the central layer in the thickness direction to the ¼ layer and the average grain diameter D (surface) of the area from the surface layer in the thickness direction to the ¼ layer may satisfy a relationship of [Equation 1] below.

$$D(\text{surface})/D(\text{center}) \geq 0.6 \quad \text{[Equation 1]}$$

In addition, the steel sheet that has completed the final annealing has fine grains uniformly distributed on the surface portion and central portion, so that the room temperature yield strength YS (RT) of the steel sheet is 400 MPa or more and the 150° C. yield strength YS (150° C.) is 340 MPa or more, which shows excellent strength characteristics.

After the final annealing, insulating coating may be formed. The insulating coating may be treated with organic, inorganic, and organic/inorganic composite coatings, and may be treated with coating agents capable of other insulating coatings.

Hereinafter, the present invention will be described in more detail through examples. However, these examples are only for illustrating the present invention, and the present invention is not limited thereto.

Example 1

A slab was prepared with components containing components shown in Table 1, the balance being Fe, and unavoidable impurities. The slab was heated to 1,150° C. and hot-rolled at a finishing temperature of 880° C. to prepare a hot-rolled steel sheet with a plate thickness of 2.0 mm.

TABLE 1

| Specimen No. | Si [%] | Al [%] | Mn [%] | Cr [%] | Sn [%] | Sb [%] | C [ppm] | N [ppm] | S [ppm] | Ti [ppm] | Nb [ppm] | V [ppm] |
|---|---|---|---|---|---|---|---|---|---|---|---|---|
| A1 | 3.1 | 1.30 | 0.20 | 0.01 | 0.01 | 0.01 | 28 | 16 | 19 | 11 | 19 | 15 |
| A2 | 3.1 | 1.30 | 0.20 | 0.01 | 0.05 | 0.01 | 28 | 13 | 9 | 23 | 17 | 21 |
| A3 | 3.1 | 1.30 | 0.20 | 0.01 | 0.01 | 0.03 | 26 | 18 | 14 | 24 | 8 | 19 |
| A4 | 3.1 | 1.30 | 0.20 | 0.01 | 0.05 | 0.03 | 27 | 17 | 16 | 17 | 18 | 10 |
| A5 | 3.1 | 1.30 | 0.20 | 0.01 | 0.01 | 0.01 | 25 | 14 | 16 | 14 | 16 | 16 |
| A6 | 3.1 | 1.30 | 0.20 | 0.01 | 0.05 | 0.01 | 24 | 17 | 14 | 17 | 17 | 14 |
| A7 | 3.1 | 1.30 | 0.20 | 0.01 | 0.01 | 0.03 | 26 | 13 | 16 | 11 | 13 | 13 |
| A8 | 3.1 | 1.30 | 0.20 | 0.01 | 0.05 | 0.03 | 28 | 16 | 14 | 14 | 14 | 18 |
| B1 | 3.4 | 0.95 | 0.30 | 0.01 | 0.03 | 0.03 | 23 | 14 | 13 | 12 | 11 | 23 |
| B2 | 3.4 | 0.95 | 0.30 | 0.01 | 0.06 | 0.03 | 35 | 15 | 18 | 9 | 13 | 9 |
| B3 | 3.4 | 0.95 | 0.30 | 0.01 | 0.03 | 0.02 | 35 | 9 | 17 | 24 | 19 | 10 |
| B4 | 3.4 | 0.95 | 0.30 | 0.01 | 0.06 | 0.02 | 34 | 12 | 15 | 14 | 20 | 21 |
| B5 | 3.4 | 0.95 | 0.30 | 0.01 | 0.03 | 0.03 | 31 | 13 | 13 | 17 | 13 | 18 |
| B6 | 3.4 | 0.95 | 0.30 | 0.01 | 0.06 | 0.03 | 28 | 16 | 17 | 14 | 17 | 15 |
| B7 | 3.4 | 0.95 | 0.30 | 0.01 | 0.03 | 0.02 | 29 | 14 | 18 | 13 | 18 | 17 |
| B8 | 3.4 | 0.95 | 0.30 | 0.01 | 0.06 | 0.02 | 31 | 18 | 13 | 18 | 13 | 13 |
| C1 | 3.6 | 0.75 | 0.20 | 0.03 | 0.02 | 0.06 | 30 | 9 | 14 | 24 | 19 | 20 |
| C2 | 3.6 | 0.75 | 0.20 | 0.03 | 0.03 | 0.06 | 21 | 11 | 17 | 21 | 23 | 16 |
| C3 | 3.6 | 0.75 | 0.20 | 0.03 | 0.02 | 0.03 | 29 | 12 | 20 | 23 | 14 | 12 |
| C4 | 3.6 | 0.75 | 0.20 | 0.03 | 0.03 | 0.03 | 21 | 8 | 14 | 17 | 18 | 18 |
| C5 | 3.6 | 0.75 | 0.20 | 0.03 | 0.02 | 0.06 | 31 | 13 | 16 | 9 | 14 | 11 |
| C6 | 3.6 | 0.75 | 0.20 | 0.002 | 0.03 | 0.06 | 28 | 16 | 21 | 13 | 15 | 12 |
| C7 | 3.6 | 0.75 | 0.20 | 0.03 | 0.02 | 0.03 | 25 | 16 | 17 | 7 | 17 | 15 |
| C8 | 3.6 | 0.75 | 0.20 | 0.03 | 0.03 | 0.03 | 27 | 17 | 18 | 14 | 14 | 18 |
| D1 | 3.8 | 0.40 | 0.30 | 0.03 | 0.04 | 0.01 | 22 | 8 | 21 | 18 | 9 | 23 |
| D2 | 3.8 | 0.40 | 0.30 | 0.03 | 0.02 | 0.01 | 22 | 11 | 12 | 12 | 16 | 11 |
| D3 | 3.8 | 0.40 | 0.30 | 0.03 | 0.04 | 0.04 | 23 | 10 | 13 | 12 | 21 | 13 |
| D4 | 3.8 | 0.40 | 0.30 | 0.03 | 0.02 | 0.04 | 26 | 14 | 14 | 14 | 16 | 14 |
| D5 | 3.8 | 0.40 | 0.30 | 0.03 | 0.04 | 0.01 | 25 | 16 | 16 | 16 | 17 | 17 |
| D6 | 3.8 | 0.40 | 0.30 | 0.11 | 0.02 | 0.01 | 31 | 20 | 26 | 15 | 18 | 21 |
| D7 | 3.8 | 0.40 | 0.30 | 0.03 | 0.04 | 0.04 | 24 | 20 | 20 | 10 | 17 | 24 |
| D8 | 3.8 | 0.40 | 0.30 | 0.03 | 0.02 | 0.04 | 28 | 12 | 17 | 13 | 13 | 13 |

The hot-rolled steel sheet was subjected to pre-annealing of the hot-rolled steel sheet under the conditions of Table 2, and then cold-rolled to prepare a cold-rolled steel sheet with a thin thickness. The cold-rolled steel sheet was subjected to the final annealing under the conditions of Table 2.

TABLE 2

| | Primary pre-annealing step | | | Secondary pre-annealing step | | | Primary final annealing step | | | Secondary final annealing step | |
|---|---|---|---|---|---|---|---|---|---|---|---|
| Specimen No. | Temperature rise rate [° C./s] | Soaking temperature [° C.] | Holding time [s] | Change time [s] | Soaking temperature [° C.] | Holding time [s] | Temperature rise rate [° C./s] | Soaking temperature [° C.] | Holding time [s] | Soaking temperature [° C.] | Holding time [s] |
| A1 | 7.2 | 970 | 50 | 15 | 920 | 25 | 30 | 920 | 50 | 750 | 25 |
| A2 | 11.5 | 1000 | 50 | 15 | 980 | 25 | 30 | 940 | 45 | 750 | 25 |
| A3 | 15.6 | 1020 | 50 | 15 | 920 | 25 | 30 | 960 | 70 | 750 | 25 |
| A4 | 14.6 | 1040 | 30 | 15 | 920 | 25 | 30 | 980 | 40 | 750 | 25 |
| A5 | 18.4 | 1060 | 50 | 15 | 860 | 25 | 20 | 1000 | 40 | 750 | 25 |
| A6 | 12.6 | 1080 | 50 | 15 | 860 | 25 | 30 | 1020 | 35 | 750 | 10 |
| A7 | 13.7 | 1100 | 50 | 15 | 860 | 25 | 30 | 1040 | 35 | 750 | 25 |
| A8 | 15.6 | 1120 | 50 | 15 | 860 | 25 | 30 | 1060 | 30 | 750 | 25 |
| B1 | 16.3 | 1120 | 50 | 15 | 880 | 25 | 35 | 875 | 30 | 800 | 25 |
| B2 | 14.7 | 1100 | 50 | 15 | 880 | 15 | 35 | 1040 | 30 | 800 | 25 |
| B3 | 15.4 | 1080 | 50 | 30 | 880 | 25 | 35 | 1020 | 35 | 800 | 25 |
| B4 | 16.3 | 1060 | 50 | 15 | 815 | 25 | 35 | 1000 | 35 | 800 | 25 |
| B5 | 12.7 | 1040 | 50 | 15 | 870 | 25 | 35 | 980 | 40 | 620 | 25 |
| B6 | 11.9 | 1020 | 50 | 15 | 870 | 25 | 35 | 960 | 40 | 800 | 10 |
| B7 | 14.9 | 1000 | 50 | 15 | 870 | 25 | 35 | 940 | 45 | 800 | 20 |
| B8 | 17.2 | 980 | 50 | 15 | 870 | 25 | 35 | 920 | 50 | 800 | 20 |
| C1 | 14.7 | 1130 | 50 | 15 | 920 | 15 | 40 | 920 | 50 | 700 | 20 |
| C2 | 13.5 | 1130 | 50 | 15 | 920 | 25 | 40 | 940 | 45 | 910 | 20 |
| C3 | 14.6 | 1170 | 50 | 15 | 920 | 25 | 40 | 960 | 40 | 700 | 20 |
| C4 | 16.2 | 925 | 50 | 15 | 920 | 25 | 40 | 980 | 30 | 700 | 20 |
| C5 | 17.5 | 970 | 50 | 15 | 920 | 25 | 40 | 1000 | 80 | 700 | 20 |
| C6 | 16.5 | 970 | 50 | 15 | 920 | 25 | 40 | 1000 | 35 | 700 | 20 |
| C7 | 14.2 | 970 | 50 | 15 | 920 | 25 | 40 | 1020 | 35 | 700 | 20 |
| C8 | 14.3 | 970 | 50 | 15 | 920 | 25 | 40 | 1040 | 30 | 700 | 20 |
| D1 | 8.9 | 1050 | 50 | 15 | 900 | 30 | 30 | 950 | 40 | 750 | 20 |
| D2 | 12.9 | 1050 | 30 | 15 | 900 | 30 | 35 | 1000 | 50 | 750 | 20 |
| D3 | 16.3 | 1050 | 50 | 15 | 900 | 30 | 20 | 1000 | 40 | 750 | 20 |
| D4 | 13.5 | 1050 | 50 | 30 | 900 | 30 | 25 | 950 | 50 | 750 | 20 |
| D5 | 12.6 | 1050 | 50 | 15 | 900 | 30 | 30 | 875 | 50 | 750 | 20 |
| D6 | 13.2 | 1050 | 50 | 15 | 900 | 30 | 25 | 950 | 45 | 750 | 20 |
| D7 | 16.3 | 1050 | 50 | 15 | 900 | 30 | 25 | 950 | 40 | 750 | 20 |
| D8 | 13.6 | 1050 | 50 | 15 | 900 | 30 | 30 | 1000 | 50 | 750 | 20 |

The final plate thickness, average grain diameter, and area fraction and number fraction of fine grains whose diameter is 10% or less of a plate thickness, D (center), D (surface), D (surface)/D (center), YS (RT), YS (150° C.), W10/400 core loss, and B50 magnetic flux density were measured and shown in Table 3, respectively.

In this case, the content of each component was measured by an ICP wet analysis method. The average diameter of grains and the area fraction and number fraction of fine grains were measured by EBSD so that a TD cross section of a specimen is polished to an area of 100 $mm^2$ or more, and then, merged by a merge function of OIM software, and the average, area fraction, and number fraction values obtained when calculated with the grain diameter (diameter) function were used.

As the D (center) value, the grain diameter (diameter) average value calculated from the data cropped from the center of the thickness layer to the ¼ thickness layer in the above-described EBSD measurement data was used, and as the D (surface) value, the grain diameter (diameter) average value calculated from the data cropped from the surface of the thickness layer to the ¼ thickness layer was used.

Tensile tests at room temperature and 150° C. were performed according to ISO 6892-1,2 standards. For the magnetic properties such as the magnetic flux density and core loss, 5 specimens of width 60 mm×length 60 mm×number of sheets were cut for each specimen, and the rolling direction and rolling vertical direction were measured with a single sheet tester, and the average values were shown.

In this case, W10/400 means the core loss when a magnetic flux density of 1.0 T is induced at a frequency of 400 Hz, and B50 means the magnetic flux density induced in a magnetic field of 5,000 A/m

TABLE 3

| Speicimen No. | Thickness [mm] | Average grainsize [μm] | Fine grain area fraction | Fine grain number fraction | D (center) [μm] | D (surface) [μm] | D (surface)/ D(center) | YS (RT) [MPa] | YS (150° C.) [MPa] | W10/ 400 [W/kg] | B50 [T] | Remarks |
|---|---|---|---|---|---|---|---|---|---|---|---|---|
| A1 | 0.25 | 62 | 2.1 | 38 | 81 | 43 | 0.53 | 436 | 372 | 12.9 | 1.67 | Comparative Example |
| A2 | 0.25 | 71 | 0.3 | 16 | 77 | 65 | 0.84 | 394 | 335 | 11.4 | 1.67 | Comparative Example |

TABLE 3-continued

| Speicimen No. | Thickness [mm] | Average grainsize [μm] | Fine grain area fraction | Fine grain number fraction | D (center) [μm] | D (surface) [μm] | D (surface)/ D(center) | YS (RT) [MPa] | YS (150° C.) [MPa] | W10/ 400 [W/kg] | B50 [T] | Remarks |
|---|---|---|---|---|---|---|---|---|---|---|---|---|
| A3 | 0.25 | 160 | 1.8 | 33 | 174 | 146 | 0.84 | 392 | 331 | 11.5 | 1.67 | Comparative Example |
| A4 | 0.25 | 92 | 0.2 | 17 | 103 | 81 | 0.79 | 390 | 332 | 11.4 | 1.67 | Comparative Example |
| A5 | 0.25 | 105 | 1.6 | 35 | 138 | 72 | 0.52 | 420 | 359 | 13.2 | 1.67 | Comparative Example |
| A6 | 0.25 | 117 | 0.3 | 16 | 128 | 106 | 0.83 | 394 | 332 | 11.6 | 1.67 | Comparative Example |
| A7 | 0.25 | 123 | 1.4 | 32 | 131 | 115 | 0.88 | 409 | 347 | 11.5 | 1.67 | Inventive Example |
| A8 | 0.25 | 138 | 1.6 | 29 | 149 | 127 | 0.85 | 406 | 343 | 11.6 | 1.67 | Inventive Example |
| B1 | 0.25 | 41 | 1.9 | 30 | 46 | 36 | 0.78 | 458 | 387 | 12.8 | 1.67 | Comparative Example |
| B2 | 0.25 | 136 | 0.3 | 18 | 152 | 120 | 0.79 | 392 | 334 | 11.3 | 1.67 | Comparative Example |
| B3 | 0.25 | 124 | 0.3 | 16 | 134 | 114 | 0.85 | 391 | 332 | 11.4 | 1.67 | Comparative Example |
| B4 | 0.25 | 112 | 0.2 | 16 | 116 | 108 | 0.93 | 394 | 330 | 11.6 | 1.67 | Comparative Example |
| B5 | 0.25 | 103 | 0.3 | 15 | 109 | 97 | 0.89 | 396 | 332 | 11.3 | 1.67 | Comparative Example |
| B6 | 0.25 | 94 | 0.4 | 17 | 99 | 89 | 0.90 | 392 | 335 | 11.6 | 1.67 | Comparative Example |
| B7 | 0.25 | 82 | 1.8 | 26 | 88 | 76 | 0.86 | 437 | 370 | 11.5 | 1.67 | Inventive Example |
| B8 | 0.25 | 72 | 1.2 | 31 | 77 | 67 | 0.87 | 445 | 379 | 11.4 | 1.67 | Inventive Example |
| C1 | 0.25 | 65 | 0.2 | 16 | 69 | 61 | 0.88 | 392 | 332 | 11.5 | 1.67 | Comparative Example |
| C2 | 0.25 | 78 | 0.3 | 17 | 83 | 73 | 0.88 | 395 | 331 | 11.5 | 1.67 | Comparative Example |
| C3 | 0.25 | 85 | 0.1 | 17 | 91 | 79 | 0.87 | 390 | 333 | 11.3 | 1.67 | Comparative Example |
| C4 | 0.25 | 92 | 0.2 | 16 | 99 | 85 | 0.86 | 389 | 332 | 11.5 | 1.67 | Comparative Example |
| C5 | 0.25 | 166 | 1.4 | 32 | 181 | 151 | 0.83 | 389 | 330 | 11.4 | 1.67 | Comparative Example |
| C6 | 0.25 | 106 | 1.1 | 31 | 114 | 62 | 0.54 | 428 | 359 | 13.1 | 1.67 | Comparative Example |
| C7 | 0.25 | 108 | 1.6 | 33 | 115 | 101 | 0.88 | 432 | 366 | 11.4 | 1.67 | Inventive Example |
| C8 | 0.25 | 126 | 1.7 | 28 | 138 | 114 | 0.83 | 422 | 357 | 11.5 | 1.67 | Inventive Example |
| D1 | 0.2 | 91 | 1.2 | 27 | 123 | 59 | 0.48 | 442 | 381 | 12.1 | 1.66 | Comparative Example |
| D2 | 0.2 | 106 | 0.3 | 17 | 120 | 92 | 0.77 | 390 | 332 | 10.5 | 1.66 | Comparative Example |
| D3 | 0.2 | 110 | 1.8 | 29 | 142 | 78 | 0.55 | 437 | 371 | 12.3 | 1.66 | Comparative Example |
| D4 | 0.2 | 87 | 0.2 | 16 | 93 | 81 | 0.87 | 391 | 333 | 10.4 | 1.66 | Comparative Example |
| D5 | 0.2 | 39 | 1.9 | 35 | 45 | 33 | 0.73 | 467 | 401 | 11.9 | 1.66 | Comparative Example |
| D6 | 0.2 | 83 | 1.5 | 29 | 89 | 52 | 0.58 | 449 | 378 | 12.0 | 1.66 | Comparative Example |
| D7 | 0.2 | 81 | 1.6 | 31 | 86 | 76 | 0.88 | 448 | 381 | 10.3 | 1.66 | Inventive Example |
| D8 | 0.2 | 96 | 1.4 | 25 | 103 | 89 | 0.86 | 437 | 371 | 10.5 | 1.66 | Inventive Example |

As shown in Table 3, in the case of A7, A8, B7, B8, C7, C8, D7, and D8 that fall within the range of the present invention, since the component content is appropriately adjusted, and the conditions for the second stage pre-annealing and the second stage final annealing are properly controlled, the size and distribution of grains were fine and uniform, resulting in excellent yield strength and magnetic properties.

However, in A1, A5, B1, C6, D1, D3, D5, and D6, when any of the Cr content, the primary pre-annealing temperature rise rate, the first final annealing temperature rise rate, and the soaking temperature is out of the range of the present invention, it was confirmed that the W10/400 characteristic was poor because the average grain diameter was too small or the fine grains were concentrated on the surface layer.

In addition, in the case of A2, A3, A4, A6, B2, B3, B4, B5, B6, C1, C2, C3, C4, C5, D1, D2, D3, D4, and D5, when the conditions for two-step pre-annealing and two-step final annealing were out of the range of the present invention, it was confirmed that the average grain diameter was too large or too small or the fraction of fine grains was low, and thus, the yield strength at room temperature and 150° C. was insufficient.

The present invention is not limited to the exemplary embodiments, but may be manufactured in a variety of different forms, and the present invention may be manufactured in a variety of different forms, and those of ordinary skill in the art to which the present invention pertains will understand that the present invention may be implemented in other specific forms without changing the technical spirit or essential features of the present invention. Therefore, it should be understood that the above-mentioned exemplary embodiments are exemplary in all aspects but are not limited thereto.

The invention claimed is:

1. A non-oriented electrical steel sheet, comprising:

by wt %, Si: 3.0 to 4.0%, Al: 0.1 to 1.5%, Mn: 0.1 to 0.5%, Cr: 2 to 20% of Mn content, a sum of Sn and Sb: 0.006 to 0.1%, C: 0.0010 to 0.0050%, and 0.0003 to 0.0050% of at least one of N, S, Ti, Nb, and V, and balance being Fe and unavoidable impurities, wherein an area fraction of a grain having a grain diameter which is 10% or less of a thickness of the steel sheet is 0.5% or more, a number fraction of the grain is 20% or more, and an average grain diameter from a central layer to a surface layer in a thickness direction of the steel sheet satisfies a relationship of Equation 1 below, $$D(\text{surface})/D(\text{center}) \geq 0.6 \quad \text{[Equation 1]},$$

wherein, in Equation 1, D (surface): represents average grain diameter of a region from the surface layer in the thickness direction of the steel sheet to a ¼ layer, D (center): represents an average grain diameter of a region from a central layer to the ¼ layer in the thickness direction of the steel sheet.

2. The non-oriented electrical steel sheet of claim 1, wherein:

the average grain diameter of the steel sheet is 50 to 150 μm.

3. The non-oriented electrical steel sheet of claim 1, wherein:

a yield strength YS (RT) of the steel sheet is 400 MPa or more and a 150° C. yield strength YS (150° C.) is 340 MPa or more.

4. The non-oriented electrical steel sheet of claim 1, wherein:

a thickness of the steel sheet is 0.1 to 0.35 mm.

* * * * *